US008308583B2

(12) United States Patent
Morris et al.

(10) Patent No.: US 8,308,583 B2
(45) **Date of Patent: *Nov. 13, 2012**

(54) GOLF CLUB HEAD WITH ALIGNMENT SYSTEM

(75) Inventors: Thomas C. Morris, Carlsbad, CA (US); Peter L. Soracco, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/079,398

(22) Filed: Apr. 4, 2011

(65) Prior Publication Data

US 2011/0190070 A1 Aug. 4, 2011

Related U.S. Application Data

(63) Continuation of application No. 11/711,112, filed on Feb. 27, 2007, now Pat. No. 7,918,745, which is a continuation-in-part of application No. 11/258,077, filed on Oct. 26, 2005, now Pat. No. 7,351,162, which is a continuation-in-part of application No. 10/637,530, filed on Aug. 11, 2003, now Pat. No. 7,022,030.

(51) Int. Cl.
*A63B 53/06* (2006.01)

(52) U.S. Cl. ..... 473/335; 473/340

(58) Field of Classification Search ..... 473/340–341, 473/334–339, 251–255

See application file for complete search history.

(56) References Cited

U.S. PATENT DOCUMENTS 1,289,192 A 12/1918 Klin
3,516,674 A 6/1970 Scarborogh
3,691,000 A 9/1972 Kalnin
3,873,094 A 3/1975 Sebo et al.
3,880,430 A 4/1975 McCabe (Continued)

FOREIGN PATENT DOCUMENTS

JP 59-061054 4/1984

(Continued)

OTHER PUBLICATIONS

"He Shoots, He Scores, Edge Glow Compound Lights The path To Success". RTP Engineering Plastics. http://www.rtpcompany.com/news/clines/2003/dec/golfputter.htm, 2003, printed Feb. 9, 2011, in 2 pages.

(Continued)

*Primary Examiner* — Stephen L. Blau
(74) *Attorney, Agent, or Firm* — Mark S. Leonardo; Brown Rudnick LLP

(57) ABSTRACT

A golf club head is disclosed. The golf club head includes a first body member and a second body member. The first body member includes a strike face and a top portion. The second body member is coupled to the first body member and extends away from the first body member in a direction opposite the strike face. At least a top portion of the second body member is camouflaged. A preferred method of camouflage is color differentiation, wherein the second body member is darker than the first body member. Specific color values and club head geometries are also disclosed and claimed. The club head may include a body member and a weight member such as a bar that extends rearward from the body member. A cover may be included to camouflage the weight member. A separate core member and high visibility sight lines may also be provided.

13 Claims, 15 Drawing Sheets

U.S. PATENT DOCUMENTS

| | | | | | |
|---|---|---|---|---|---|
| 3,966,210 | A | | 6/1976 | Rozmus | |
| 4,199,144 | A | * | 4/1980 | Skelly | 473/251 |
| D256,262 | S | | 8/1980 | Benson | |
| 4,530,505 | A | | 7/1985 | Stuff | |
| 4,741,535 | A | * | 5/1988 | Leonhardt | 473/252 |
| 4,824,114 | A | | 4/1989 | Catalano | |
| 4,852,879 | A | * | 8/1989 | Collins | 473/251 |
| 4,962,931 | A | | 10/1990 | Jazdzyk, Jr. | |
| 4,986,544 | A | * | 1/1991 | Benson | 473/254 |
| 5,050,879 | A | | 9/1991 | Sun et al. | |
| D324,555 | S | | 3/1992 | Evans | |
| 5,417,429 | A | * | 5/1995 | Strand | 473/251 |
| D360,669 | S | * | 7/1995 | Buscemi et al. | D21/743 |
| 5,492,327 | A | | 2/1996 | Biafoare, Jr. | |
| 5,558,332 | A | | 9/1996 | Cook | |
| 5,616,088 | A | | 4/1997 | Aizawa et al. | |
| D380,801 | S | | 7/1997 | Steele | |
| 5,676,603 | A | | 10/1997 | Miller | |
| 5,709,616 | A | | 1/1998 | Rife | |
| 5,769,737 | A | * | 6/1998 | Holladay et al. | 473/336 |
| 5,871,407 | A | * | 2/1999 | Tseng | 473/328 |
| 5,876,293 | A | | 3/1999 | Musty | |
| 5,924,938 | A | | 7/1999 | Hines | |
| 6,015,354 | A | * | 1/2000 | Ahn et al. | 473/256 |
| 6,048,275 | A | | 4/2000 | Gedeon | |
| 6,095,931 | A | * | 8/2000 | Hettinger et al. | 473/341 |
| 6,139,442 | A | | 10/2000 | Wilson | |
| 6,224,494 | B1 | | 5/2001 | Patsky | |
| 6,394,910 | B1 | | 5/2002 | McCarthy | |
| 6,435,979 | B1 | | 8/2002 | Mounfield, Jr. | |
| 6,450,894 | B1 | * | 9/2002 | Sun et al. | 473/252 |
| 6,524,193 | B1 | | 2/2003 | Devore | |
| 6,558,268 | B2 | | 5/2003 | Tindale | |
| 6,607,452 | B2 | | 8/2003 | Helmstetter et al. | |
| 6,679,782 | B2 | | 1/2004 | Tang et al. | |
| 6,716,110 | B1 | | 4/2004 | Ballow | |
| 6,743,112 | B2 | | 6/2004 | Nelson | |
| 6,796,911 | B2 | | 9/2004 | Grace | |
| 6,929,564 | B2 | * | 8/2005 | Olsavsky et al. | 473/340 |
| 6,988,955 | B2 | | 1/2006 | Stoakes | |
| D521,582 | S | | 5/2006 | Souza et al. | |
| 7,052,409 | B2 | | 5/2006 | Goldsmith | |
| 7,147,573 | B2 | * | 12/2006 | DiMarco | 473/324 |
| 7,156,752 | B1 | * | 1/2007 | Bennett | 473/334 |
| 7,166,041 | B2 | * | 1/2007 | Evans | 473/334 |
| 7,226,362 | B1 | | 6/2007 | Schell et al. | |
| 7,491,135 | B1 | * | 2/2009 | Rollinson | 473/342 |
| 7,749,105 | B2 | * | 7/2010 | Zielke et al. | 473/350 |
| 7,766,762 | B2 | | 8/2010 | Stellander | |
| 2001/0049310 | A1 | | 12/2001 | Cheng et al. | |
| 2002/0013180 | A1 | | 1/2002 | Kajita | |
| 2002/0098911 | A1 | | 7/2002 | Nelson et al. | |
| 2002/0103039 | A1 | | 8/2002 | Shmoldas et al. | |
| 2002/0160849 | A1 | | 10/2002 | Thomas | |
| 2003/0045373 | A1 | | 3/2003 | Field | |
| 2003/0114243 | A1 | | 6/2003 | Yeh | |
| 2003/0207722 | A1 | | 11/2003 | Hess et al. | |
| 2004/0063516 | A1 | * | 4/2004 | Cameron | 473/340 |
| 2004/0173964 | A1 | | 9/2004 | Pollman | |
| 2005/0137024 | A1 | * | 6/2005 | Stites et al. | 473/291 |
| 2005/0227783 | A1 | * | 10/2005 | Olsavsky et al. | 473/340 |
| 2005/0272522 | A1 | | 12/2005 | Chen et al. | |
| 2006/0040765 | A1 | * | 2/2006 | Sano | 473/340 |
| 2006/0068935 | A1 | | 3/2006 | Tang et al. | |
| 2006/0252576 | A1 | | 11/2006 | Lo | |
| 2007/0173344 | A1 | | 7/2007 | Burch | |

FOREIGN PATENT DOCUMENTS

| | | | | |
|---|---|---|---|---|
| JP | 60-132765 | | | 9/1985 |
| JP | 2001-178857 | | | 12/1988 |
| JP | 64-028672 | | | 2/1989 |
| JP | 3033033 | | | 10/1996 |
| JP | 10-127834 | | | 5/1998 |
| JP | 3061925 | | | 6/1999 |
| JP | 2000-51408 | | | 2/2000 |
| JP | 2000-051409 | | | 2/2000 |
| JP | 2001-170233 | | | 6/2001 |
| JP | 2003-70941 | | | 3/2003 |
| JP | 3107229 | | | 12/2004 |
| JP | 2005-065796 | | | 3/2005 |
| JP | 2005160691 | A | * | 6/2005 |
| JP | 2005-270180 | | | 10/2005 |
| WO | WO 2004/062735 | | | 7/2004 |

OTHER PUBLICATIONS

Japanese Office Action dated Jun. 19, 2009 of corresponding Japanese Patent Application No. 2006-291558.

Molinaro, Hope, "Peek A Boo Golf Putter" Plastics Engineering, Nov. 1, 2004, http://goliath.ecnext.com/coms2/gi_0199-3444136/More-assistance-for-duffers-Products.html.

Non-Final Office Action dated Dec. 4, 2009 of corresponding U.S. Appl. No. 11/258,078.

The Random House College Dictionary, Edition 1975, p. 833.

Thilmany, et al., "News and Notes." Mechanical Engineering, Jul. 2004, in 5 pages.

* cited by examiner

GOLF CLUB HEAD WITH ALIGNMENT SYSTEM

CROSS-REFERENCE TO RELATED APPLICATIONS

This is a continuation of U.S. patent application Ser. No. 11/711,112, filed on Feb. 27, 2007, which is a continuation-in-part of U.S. patent application Ser. No. 11/258,077, filed on Oct. 26, 2005, now U.S. Pat. No. 7,351,162, which is a continuation-in-part of U.S. patent application Ser. No. 10/637,530 filed on Aug. 11, 2003, now U.S. Pat. No. 7,022,030. These documents are incorporated herein by reference in their entireties.

BACKGROUND OF THE INVENTION

1. Field of the Invention

The present invention relates to a golf club head. In particular, the present invention relates to a golf club head having two body members, one of which being camouflaged. More particularly, the present invention relates to a golf club head having two body members of differing color.

2. Description of the Related Art

There are many styles of putters, including blades, mallets, heel-toe weighted, and T-line putters. Different types of putters provide different advantages. For example, increasing the club head moment of inertia (MOI) and moving the center of gravity away from the strike face can increase the forgiveness and accuracy of putters. Heel-toe weighted putters also increase the MOI to provide forgiveness on off-center hits.

However, some of these putter designs produce large putter club heads. While these designs have improved putter performance, they have largely ignored aesthetic considerations. An extended club body may have the deleterious effect of distracting the user. This is particularly undesirable in golf, since golf is a very "mental" sport.

Thus, what is needed is an improved golf club head that allows for technical improvements but that does not distract the golfer during use.

SUMMARY OF THE INVENTION

The golf club head of the present invention solves the deficiencies identified above. The golf club head of the present invention has a first body member and a second body member. The second body member can be integral with the first body member, or it can be independent of and coupled to the first body member. The first body member has a strike face, which may be either integral with the first body member or independent of and coupled to the first body member. The second body member extends away from the first body member in a direction opposite the strike face. A weight member may be coupled to the second body member, or the second body member may have a greater specific gravity than the first body member. The golf club preferably is a putter.

The second body member is preferably camouflaged. This may be done by making the top portion of the second body member a darker color than the top portion of the first body member. The second body member top portion is preferably substantially black, and the first body member top portion is preferably substantially grey. This color differentiation, or means of concealment, makes the club head appear smaller than it actually is.

The first body member top portion is preferably a first color having an L* value of approximately 35 to approximately 100. The second body member top portion is preferably a second color having an L* value of approximately 2 to approximately 35. The first color L* value is more preferably approximately 40 to approximately 60, and still more preferably approximately 45. The second color L* value is more preferably approximately 20 to approximately 30, and still more preferably approximately 25. Alternatively, the first L* value is preferably approximately one-and-a-quarter to two times the second L* value, and more preferably approximately one-and-a-halftimes the second L* value.

The first body member top portion has a first area and the second body member top portion has a second area, the first and second areas combining to form a total top area for the club head. The first area comprises approximately 20% to approximately 80% of the total top area, and the second area comprises approximately 20% to approximately 80% of the total top area. More preferably, the first area comprises approximately two-thirds of the total top area and the second area comprises approximately one-third of the total top area.

The first area has a first depth and the second area has a second depth, the depths measured in the face-to-rear direction. The second depth is preferably approximately one-half to approximately two times the first depth. More preferably, the second depth is approximately two-thirds times the first depth.

The golf club head has a width, measured in the toe-to-heel direction. The first depth is preferably approximately one-half to approximately one times the width, and more preferably approximately two-thirds times the width. The first depth plus the second depth is approximately one-half to one times the width, and more preferably approximately three quarters to approximately one times the width.

The golf club head has a center of gravity. The center of gravity is preferably located a distance of approximately one inch to approximately five inches back from the strike face. More preferably, the center of gravity is located a distance of approximately two inches to approximately four inches back from the strike face. Still more preferably, the center of gravity is located a distance of approximately three-and-three-quarters inches back from the strike face.

The golf club head has a MOI measured about a substantially vertical axis passing through the center of gravity when the golf club head is on a substantially horizontal surface. The MOI is preferably approximately 4000 $g \cdot cm^2$ to approximately 6000 $g \cdot cm^2$, and is more preferably approximately 4750 $g \cdot cm^2$ to 5250 $g \cdot cm^2$.

The golf club head has a MOI measured about an axis passing through the center of gravity that is substantially horizontal and perpendicular to the strike face when the golf club head is on a substantially horizontal surface. The MOI is preferably approximately 2500 $g \cdot cm^2$ to approximately 4500 $g \cdot cm^2$, and is more preferably approximately 2800 $g \cdot cm^2$ to 3500 $g \cdot cm^2$.

The golf club head has a MOI measured about an axis passing through the center of gravity that is substantially horizontal and parallel to the strike face when the golf club head is on a substantially horizontal surface. The MOI is preferably approximately 2000 $g \cdot cm^2$ to approximately 3000 $g \cdot cm^2$, and is more preferably approximately 2300 $g \cdot cm^2$ to 2500 $g \cdot cm^2$.

The golf club head may include a sight line to help the user line up the golf shot. The sight line may be on only the first body member, or it may be on both the first and second body members.

The weight member may be provided in the form of a bar that is attached to a rear portion of the body member. In one embodiment, the weight bar includes a slot into which one or more individual weights are adjustably positioned. Isolating the weight of the weight member further away from the body member, such as via a bar configuration, beneficially allows the designer greater control in positioning the club head center of gravity and adjusting the club head MOI. To further enhance this control, the body member may be provided with a large central cavity into which a low density core is positioned. Removing material from the central portion of the body inherently biases the club head mass and weight toward the heel and toe, which increases the MOI and makes the club more playable and forgiving. The core may also be used to dampen unwanted vibrations, increasing the golf club feel and playability.

A cover may be included with the club head. The cover may be attached to the weight member/bar, the core, the body member, or varying combinations of these components. The cover provides a convenient means to provide the camouflaging discussed herein.

High visibility sight lines mat be included with the club bead as independent elements or as a part of another component. These sight lines have high visibility through their utilization of one or more materials that have physical properties or that have been engineered to naturally enhance, intensify, or focus light into a brighter, highly visible point or line. Two sight lines that are parallel to the strike face and perpendicular to the intended putt direction may be provided, and they may be spaced widely apart to enhance their utility in allowing the golfer to properly orient and position the golf club during use.

The club head may include a face member having an extension portion extending rearward from a back surface thereof, opposite the strike face. This extension portion may facilitate attachment of the other club head components. For example, a core member may be included atop the face member extension portion. Preferably, the core member contains slots therein to securely retain sight line subassemblies therein. A weight member, preferably having a horseshoe shape, may also be connected to the face member extension portion. The weight member may also include extensions at its endpoints that are positioned within holes on the face member back surface. Corresponding grooves and bosses may be used to facilitate connection between the club head components. The face member extension portion may from at least a part of the club head sole. The sight lines may extend, at least partially, into the club head top line.

DESCRIPTION OF THE DRAWINGS

The present invention is described with reference to the accompanying drawings, in which like reference characters reference like elements, and wherein.

DETAILED DESCRIPTION OF THE INVENTION

Figure 1:
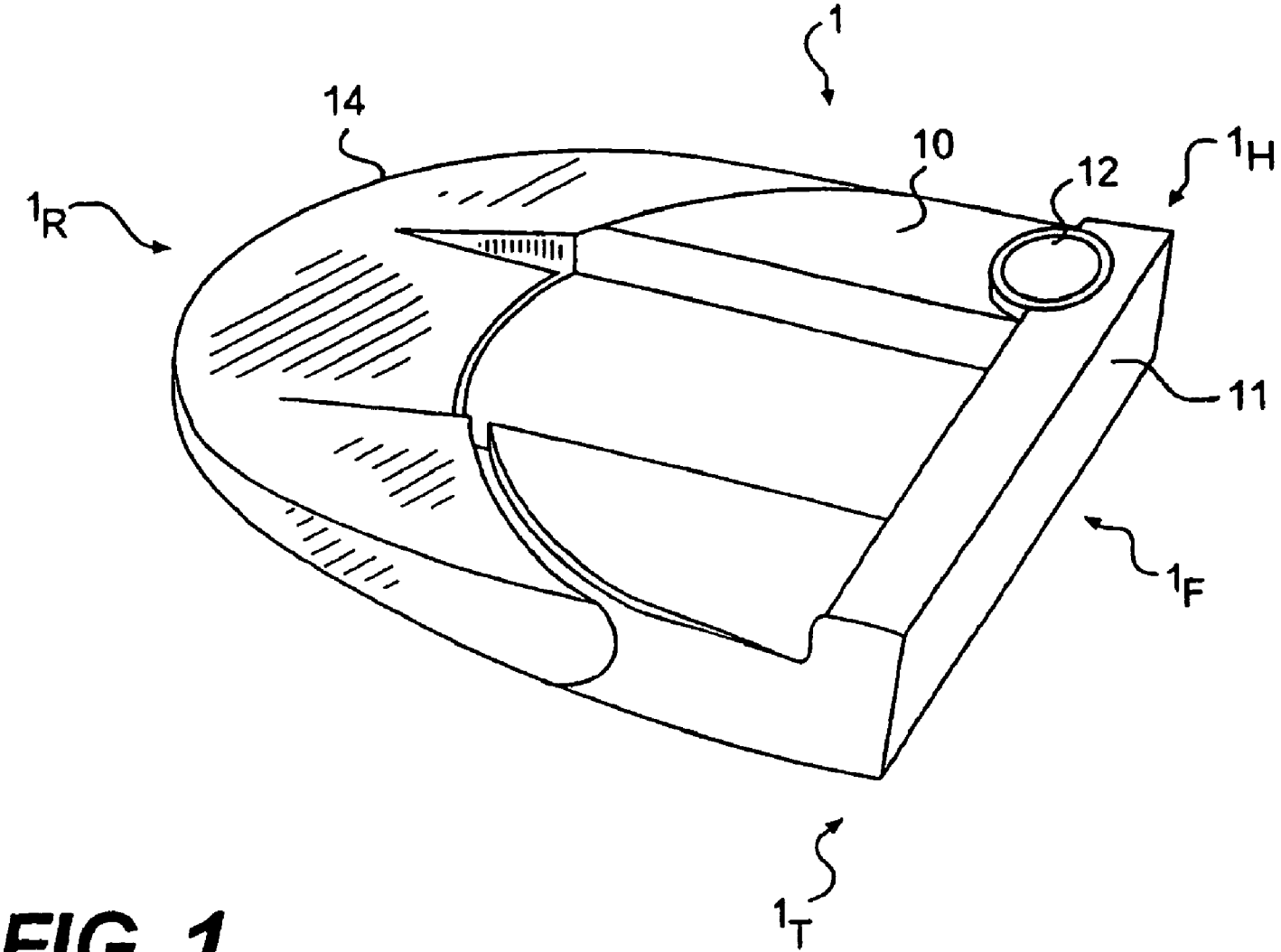
FIG. 1 shows a top view of a golf club head of the present invention.

FIG. 1 shows a top view of a golf club head 1 of the present invention. The illustrated golf club is a putter. Club head 1 includes a first body member 10 and a second body member 14. First body member 10 includes a strike face 11 that contacts a golf ball during normal use. Strike face 11 may be integral with first body member 10. Alternatively, strike face 11 may be independent of and coupled to first body member 10. Preferred means of coupling include use of an adhesive, brazing, and welding. Other coupling means, such as mechanical fasteners, may also be used. Furthermore, a combination of these coupling modes could be used. First body member 10 contains a bore 12 for connecting a shaft thereto. Club head 1 has a heel $\mathbf{1}_H$, a toe 1*r*, a face $\mathbf{1}_F$, and a rear $\mathbf{1}_R$.

Second body member 14 extends away from a rearward portion of first body member 10. Second body member 14 is preferably integral with first body member 10. Alternatively, second body member 14 may be independent of and coupled to first body member 10 in known fashion. Second body member 14 may have a weight member 18 coupled thereto. In lieu of a separate weight member 18, second body member 14 may optionally have a greater specific gravity than first body member 10.

Inclusion of second body member 14 moves the club head center of gravity backward, away from strike face 11. Moving the center of gravity backward allows for a smoother putting stroke, allowing the user to more fluidly contact the golf ball. It additionally increases the club head MOI, which helps to keep the club stable during use, which is especially beneficial during off-center hits.

An extended club body, however, may have the deleterious effect of distracting the user. This is particularly undesirable in golf, since golf is a very "mental" sport. Thus, second body member 14 is preferably camouflaged such that it is less noticeable and therefore less distracting to a golfer during use.

Figure 2:
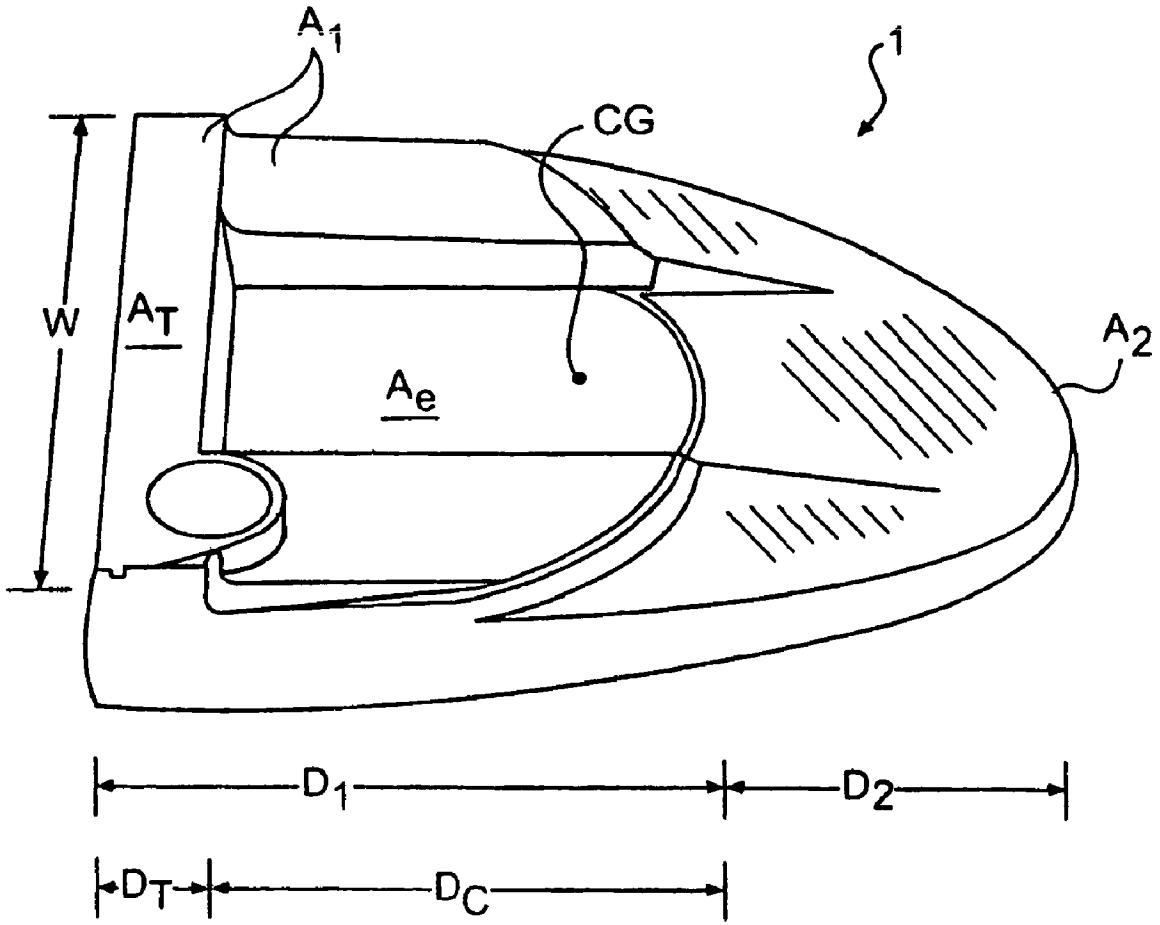
FIG. 2 shows another top view of a golf club head of the present invention.
Figure 3:
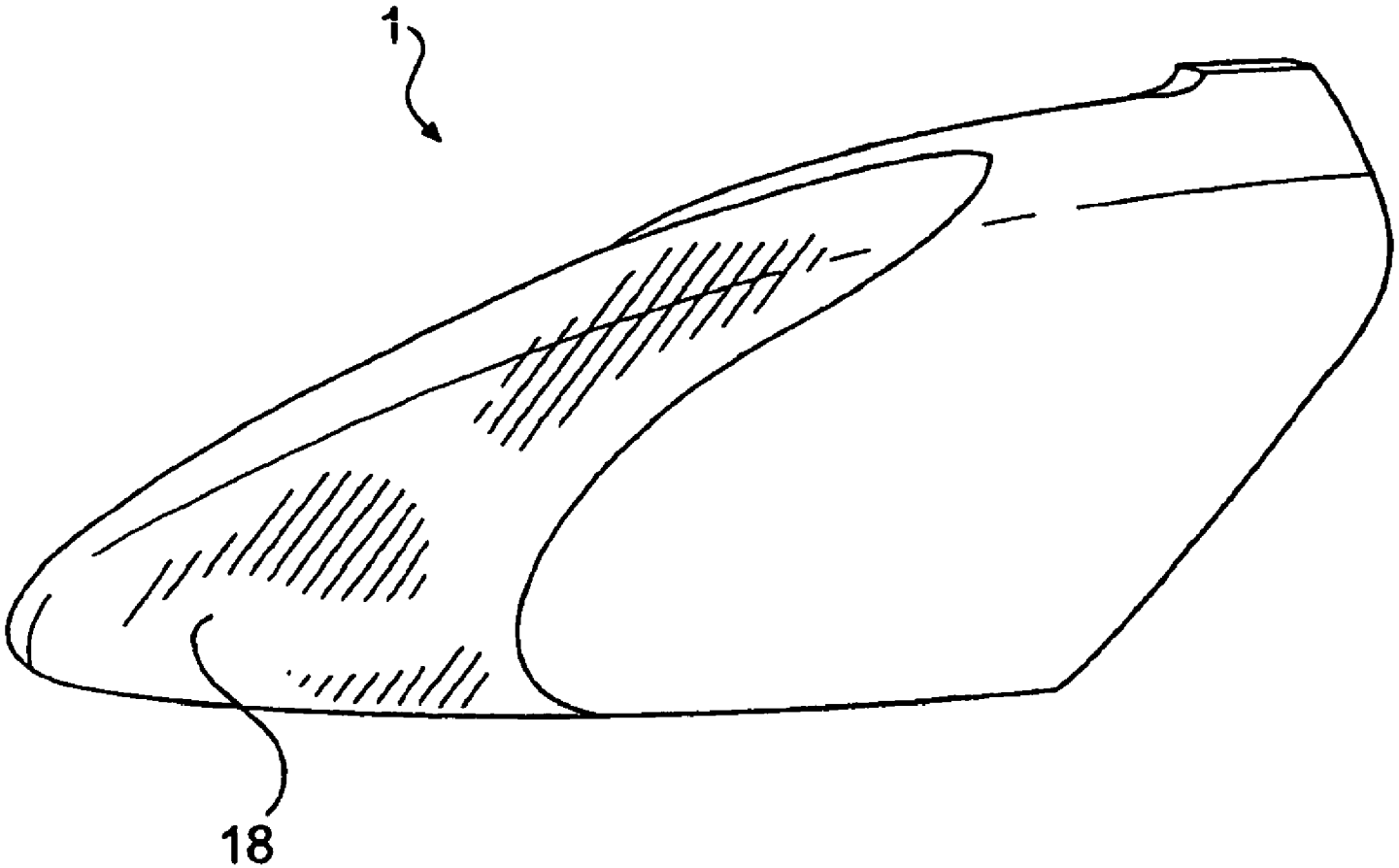
FIG. 3 shows a bottom view of a golf club head of the present invention.

A preferred method of camouflage is color differentiation. First body member 10 is of a first color, and second body member 14 is of a second color. The colors may comprise the entire outer portions of body members 10, 14, as shown in FIG. 1. Alternatively, the colors may comprise only the top portions of body members 10, 14, as shown in FIG. 2.

The second color is darker than the first color. In addition to inherently drawing one's attention to first body member 10, making second body member 14 darker also tends to make it blend into the background (the golf green for a putter). Preferably, the second color is substantially darker than the first color. More preferably, the first color is substantially grey and the second color is substantially black.

A convenient way of categorizing color and expressing colors numerically is through the CIELCh system. The CIELCh system is a standard color system that is well known in the arts of color and appearance to describe the effective color of an object. The CIELCh system defines color by three values on a cylindrical polar coordinate system—L*, C*, and h°, L* defines lightness, C* specifies chroma, and h° denotes hue angle. The CIELCh values indicate both magnitude and direction of color definition. An L* value 0 is pure black, or complete absorption of all wavelengths of light. An L* value of 100 is pure white, or complete reflection of all wavelengths of light. Thus, 0 is the minimum L* value and 100 is the maximum L* value.

L* is calculated by the following equation: $L^*=116(Y/Yn)^{1/3}-16$, where Yn is a value for a reference white and Y relates to the measured color's value in the CIELCh coordinate system.

The first color preferably has an L* value of approximately 35 to approximately 100.

The second color preferably has an L* value of approximately 2 to approximately 35. More preferably, the first color has an L* value of approximately 40 to approximately 60, and the second color has an L* value of approximately 20 to approximately 30. Still more preferably, the first color has an L* value of approximately 45, and the second color has an L* value of approximately 25.

Alternatively, the brightness values of the first and second colors can be defined by percent difference. First body member 10 has a first L* value and second body member 14 has a second L* value. Preferably, the first L* value is approximately one-and-a-quarter to two times the second L* value. More preferably, the first L* value is approximately one-and-a-halftimes the second L* value. As discussed above, at least the top portion of body members 10, 14 are colored.

As shown in FIG. 2, first body member 10 has a top portion of a first area $A_1$ and second body member 14 has a top portion of a second area $A_2$. First area $A_1$ and second area $A_2$ combine to form a total top area for the club head. The percentages of the total top area covered by first area $A_1$ and second area $A_2$ determine how club head 1 will appear in its camouflaged state to the user. Since the purpose is to make club head 1 appear as a conventional club head, first area $A_1$ preferably comprises approximately 20% to approximately 80% of the total top area and second area $A_2$ preferably comprises approximately 20% to approximately 80% of the total top area. More preferably, first area $A_1$ comprises approximately two-thirds of the total top area and second area $A_2$ comprises approximately one-third of the total top area.

The spatial relationship between first body member 10 and second body member 14 may alternatively be categorized by the depths of each area $A_1$, $A_2$. First area $A_1$ has a first depth $D_1$ and second area $A_2$ has a second depth $D_2$, depths $D_1$, $D_2$ measured in the face-to-rear direction. Second depth $D_2$ is preferably approximately one-half to approximately two times first depth $D_1$. More preferably, second depth $D_2$ is approximately two-thirds of first depth $D_1$.

The spatial relationship between first body member 10 and second body member 14 may alternatively be categorized by depths $D_1$, $D_2$ with respect to the width of club head 1. Club head 1 has a width W measured in the toe-to-heel direction. First depth $D_1$ is preferably approximately one-half to approximately one times width W, and is more preferably approximately two-thirds times width W. First depth $D_1$ plus second depth $D_2$ is approximately one-half to one times width W, and is more preferably approximately three quarters to approximately one times width W.

First area $A_1$ may be divided into a toe area $A_T$ having a toe depth $D_T$ and a crown area $A_C$ having a crown depth $D_C$. Toe area $A_T$ and crown area $A_C$ combine to form first area $A_1$ and toe depth $D_T$ and crown depth $D_C$ combine to form first depth $D_1$. Toe area $A_T$ preferably comprises approximately 10% to approximately 50% of the total top area.

When a club, such as a putter, strikes a ball off-center, there is a tendency for the club to rotate about a substantially vertical axis passing through the club head center of gravity. This club rotation causes the shot or putt to deviate from the intended course by either a push/pull (straight ball path), slice/hook (curved ball path), or combination thereof. Moving the center of gravity further back in the club head creates a greater resistance to this rotation.

Increasing a club head's MOI also creates resistance to club head rotation. Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases.

Inclusion of second body member 14 moves the center of gravity CG of club head 1 away from face $\mathbf{1}_F$ and towards rear $\mathbf{1}_R$. This is enhanced by inclusion of weight member 18 and/or increasing the specific gravity of second body member 14. Thus, second body member 14 increases the resistance to club head rotation and creates more accurate off-center shots.

Center of gravity CG is preferably located a distance of approximately one inch to approximately five inches back from strike face 11. More preferably, center of gravity CG is located a distance of approximately two inches to approximately four inches back from strike face 11. Still more preferably, center of gravity CG is located a distance of approximately three-and-three-quarters inches back from strike face 11.

Club head 1 has a MOI measured about a substantially vertical axis passing through the center of gravity when the golf club head is on a substantially horizontal surface. The MOI is preferably approximately 4000 $g\cdot cm^2$ to approximately 6000 $g\cdot cm^2$, and is more preferably approximately 4750 $g\cdot cm^2$ to 5250 $g\cdot cm^2$.

Inclusion of second body member 14 increases the MOI about the other axes as well. These increased MOI's increase the stability of club head 1. Club head 1 has a MOI measured about an axis passing through the center of gravity CG that is substantially horizontal and perpendicular to the strike face when the golf club head is on a substantially horizontal surface. The MOI is preferably approximately 2000 $g\cdot cm^2$ to approximately 3000 $g\cdot cm^2$, and is more preferably approximately 2300 $g\cdot cm^2$ to 2500 $g\cdot cm^2$. Club head 1 has a MOI measured about an axis passing through the center of gravity CG that is substantially horizontal and parallel to the strike face when the golf club head is on a substantially horizontal surface. The MOI is preferably approximately 2500 $g\cdot cm^2$ to approximately 4500 $g\cdot cm^2$, and is more preferably approximately 2800 $g\cdot cm^2$ to 3500 $g\cdot cm^2$.

Figure 4:
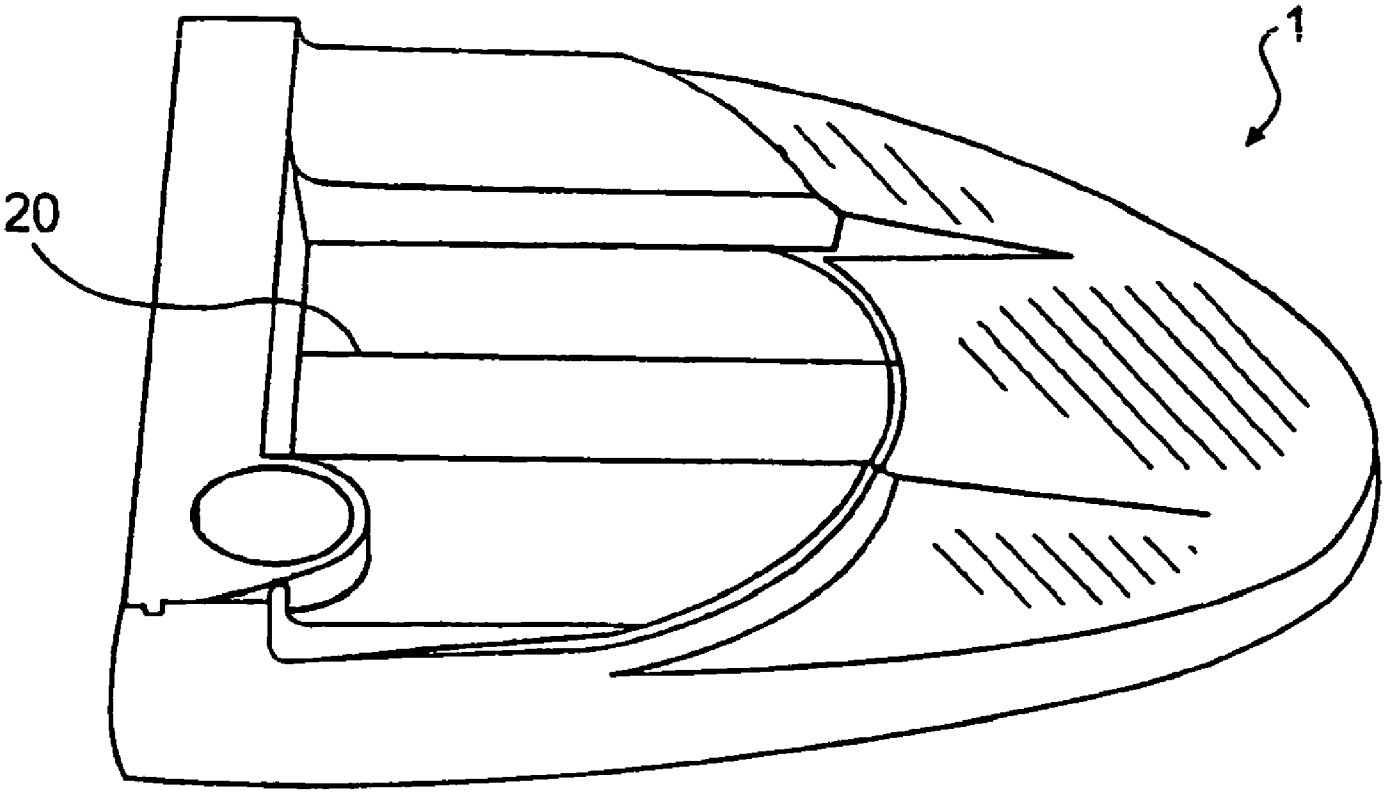
FIG. 4 shows a top view of another golf club head of the present invention.

Club head 1 may include a sight line 20, as shown in FIG. 4. Sight line 20 helps the user line up the golf shot. Since it is substantially perpendicular to strike face 11, sight line 20 therefore indicates the preferred angle for striking the golf ball. Sight line 20 preferably passes over the club head center of gravity CG, so that striking the ball on the portion of strike face 11 opposite sight line 20 results in a true putt. Sight line 20 may be on only first body member 10, or it may be on both first body member 10 and second body member 14.

Figure 5:
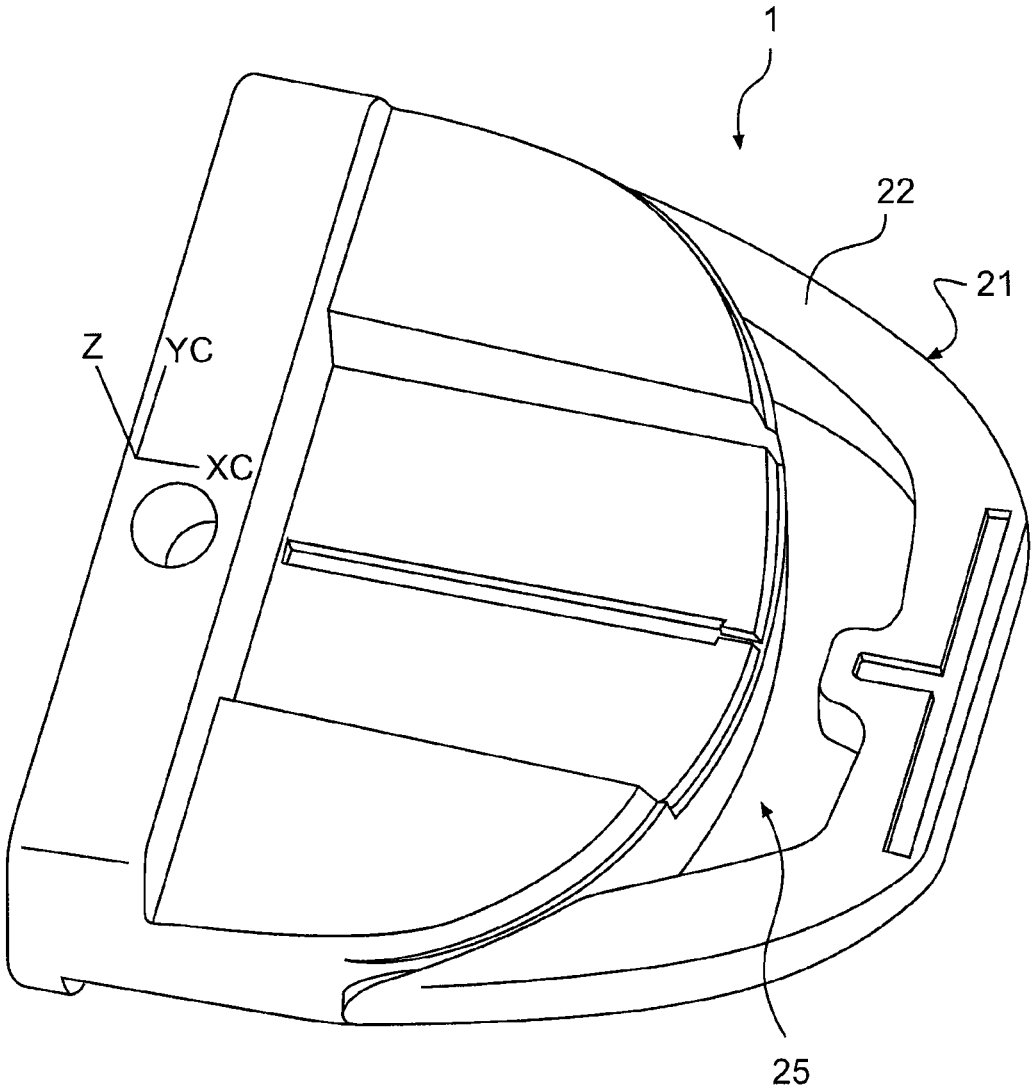
FIG. 5 shows a top view of a golf club head of the present invention.

As shown in FIG. 5, the weight member 18 of the club head 1 may be provided in the form of a bar 21 that is attached to the body member 10 and extends rearward away from the body member 10. The bar 21 facilitates moving the CG towards the rear 1R of the club head 1, enhancing the playability of the club. Preferably, the body member 10 and the weight member 21 cooperate to define a void 25, which beneficially allows the club designer to redistribute mass and weight to more useful locations on the club head 1 while maintaining the weight of the club head 1. For example, the void 25 and weight member 21 can collectively allow the club designer to optimize the CG location and MOI of the club head 1 without increasing its weight such that it becomes unwieldy. As shown in the illustrated embodiment of FIG. 5, the void 25 may stretch or extend from a toe end to a heel end of a rear portion of the body member 10. Alternatively, a central portion of the weight member 21 may extend toward and abut the body member 10, bifurcating the void 25 into two voids 25.

A cover member 22 may be included with the club head 1. The cover member 22 is attached to a top portion of the weight member 21 such that the weight member 21 is obscured from the golfer's view during normal use. The cover member includes a top portion that can be colored to provide the beneficial camouflaging described above, giving the appearance of a smaller club head than it actually is. The cover member 22 preferably covers a majority of the top portion of the weight member 21.

The weight member 21 preferably may be made of a high density material. For example, a material having a density of 6 g/cm$^3$ or more. The body member 10 preferably has a low density such as 4 g/cm$^3$ or less. The densities of these components may be expressed relatively, in which case, preferably, the weight member 21 density is at least twice the density of the body member 10.

The weight member 21 may optionally be provided as a bar having a slot into which a weight may be positioned. In this design, the bar need not be formed of a high density material, and preferably may be formed of a low density material such as plastic. This setup beneficially allows the club designer greater flexibility in designing the club, positioning the CG, and setting the MOI. The weight may be adjusted to various locations within the slot to provide a customized setup for a specific swing type or to correct an error. For example, if a golfer consistently strikes the ball in an off-center location of the strike face 11, such as toward the toe 1T, the weight can be adjusted within the slot such that the club head CG is directly behind the off-center strike location. Use of a weight allows the bar 21 to be of a low density material such as plastic or composite.

The weight preferably is permanently contained within the slot. This maybe achieved, for example, by providing a T-shaped slot within the bar 21 and capturing the weight therein. Once the weight is positioned in the desired location, it is locked in position. The weight may be permanently positioned such that it cannot subsequently be repositioned. Alternatively, the weight may be removably fixed in position such that it's position can subsequently be adjusted. While the weight can be locked in place by virtually any means, preferred means include mechanical fasteners, welding, adhesives, and the like. Multiple locking means may be used in combination to secure the weight in place.

Figure 8:
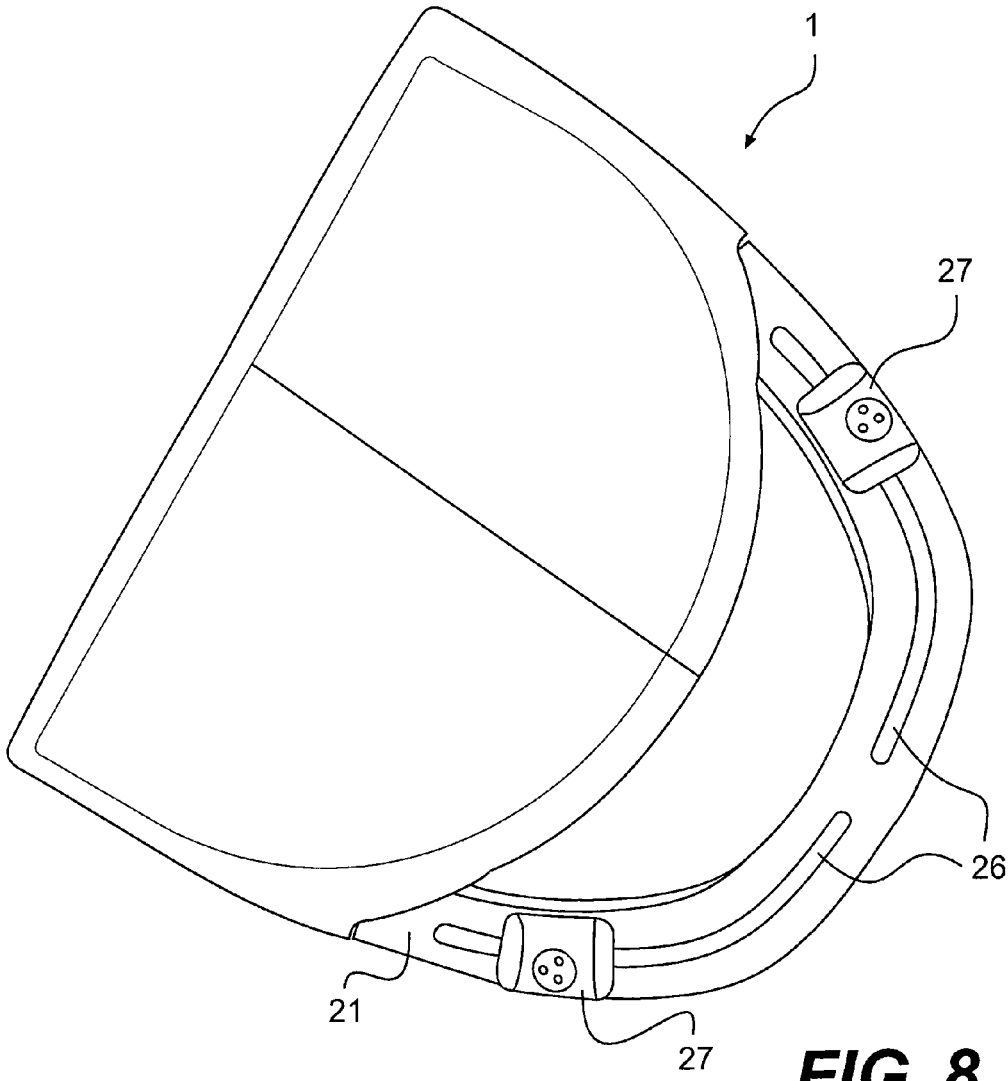
FIG. 8 shows a bottom view of a golf club head of the present invention.
Figure 8A:
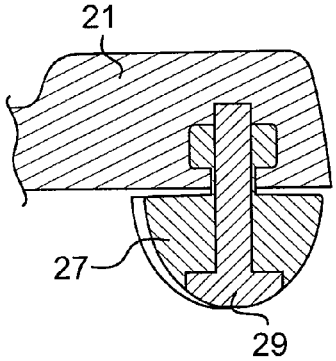
FIG. 8A shows a detail view of a weight member attachment mechanism for use with the golf club head of FIG. 8.

FIG. 8 shows a bottom view of a club head 1 with a slotted weight bar 21. The bar 21 contains one or more slots 26 into which one or more weights 27 are positioned. While two separate slots 26 are shown in the illustrated embodiment, one continuous slot 26 can be used. Similarly, two weights 27 are shown, but virtually any number of weights can be used. Multiple weights 27 can be placed within a single slot 26. FIG. 8A shows a detail view, in cross-section, illustrating how the weight member 27 is attached and retained with the bar 21. The slot 26 has a T-shape, into which a corresponding T-shaped portion of the weight member 27 has been placed. This may be achieved in a variety of ways. For example, if the slot 26 extends the full length of the bar 21, the weight 27 can be slid the end of the bar 21 prior to coupling the bar 21 to the rest of the club head 1. Alternatively, the T-shaped extension of the weight member 27 can be sized such that it may be slid into the slot 26 at any position thereof and then rotated (e.g., 90°) within the slot such that it is retained therein. Once the weight 27 has been placed within the slot 26 and positioned in the desired location, a set screw 29 is tightened to engage the bar 21, locking the weight 27 in position. The set screw 29 may preferably be provided with an unusual tool engagement surface such that it is not easily adjustable. This attachment method is but one example of the many ways in which the weight(s) 27 can be positioned.

Figure 7:
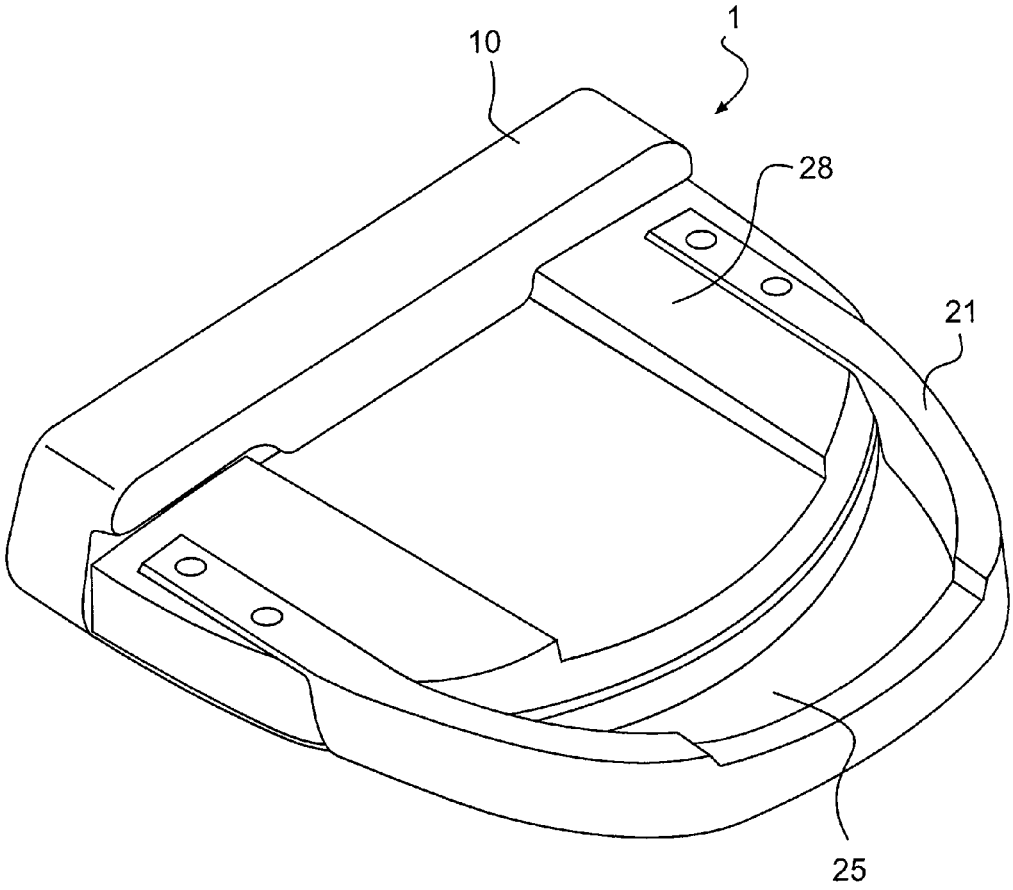
FIG. 7 shows a top view of a partially assembled club head of the present invention.

A core 28 may be included with the club head 1. FIG. 7 shows a partially assembled club head 1 including the core 28. The core 28 is configured to be received by and retained within the body member 10. The core 28 may be formed of a low density material, such as 2 g/cm$^3$ or less, to further enhance the CG and MOI benefits discussed above. The core 28 preferably has a hardness of approximately 50 Shore D. Alternatively, the core 28 hardness may be less than approximately 60 Shore D, less than approximately 50 Shore D, of from approximately 30 Shore D to approximately 45 Shore D. The body 10 and core 28 may be contoured and weighted to produce desirable MOI and acoustic characteristics during use.

Preferred MOI ranges include approximately 4000 g·cm$^2$ to approximately 10,000 g·cm$^2$, approximately 5000 g·cm$^2$ to 7000 g·cm$^2$, and approximately 5500 g·cm$^2$ to 6500 g·cm2

The club head may be provided with one or more sight lines to help the golfer properly align the club during use. Preferably, the sight lines are high visibility sight lines, meaning they utilize one or more materials having physical properties or that have been engineered to naturally enhance, intensify, or focus light into a brighter, highly visible point or line.

In one exemplary embodiment, the club head 1 is provided with a sight line incorporating a luminescent pigment, with a fluorescent pigment being preferred. The fluorescent sight line is "charged" by the ambient light and retransmits this absorbed energy such that the sight line shines or glows.

In another exemplary embodiment, the club head 1 is provided with a sight line incorporating a natural light emitting substance, such as tritium. The result is similar to the fluorescent sight lines discussed above.

In another exemplary embodiment, the club head 1 is provided with a sight line incorporating fiber optics. Ambient light is captured and channeled through the use of fiber optics. This captured light and is directed to the sight line where it is emitted, preferably upward toward the golfer. The fiber optics may be provided in the form of a continuous light emitting line, or in the form of discreet light-emitting locations along the sight line. The club head may be provided with one or more windows to capture additional ambient light that is funneled into the fiber optic sight lines. These windows may be provided in numerous forms, such as on horizontal or near-horizontal surfaces of the club head. This ambient light is then channeled, possibly through an interior portion of the club head 1, to the sight lines.

Figure 6:
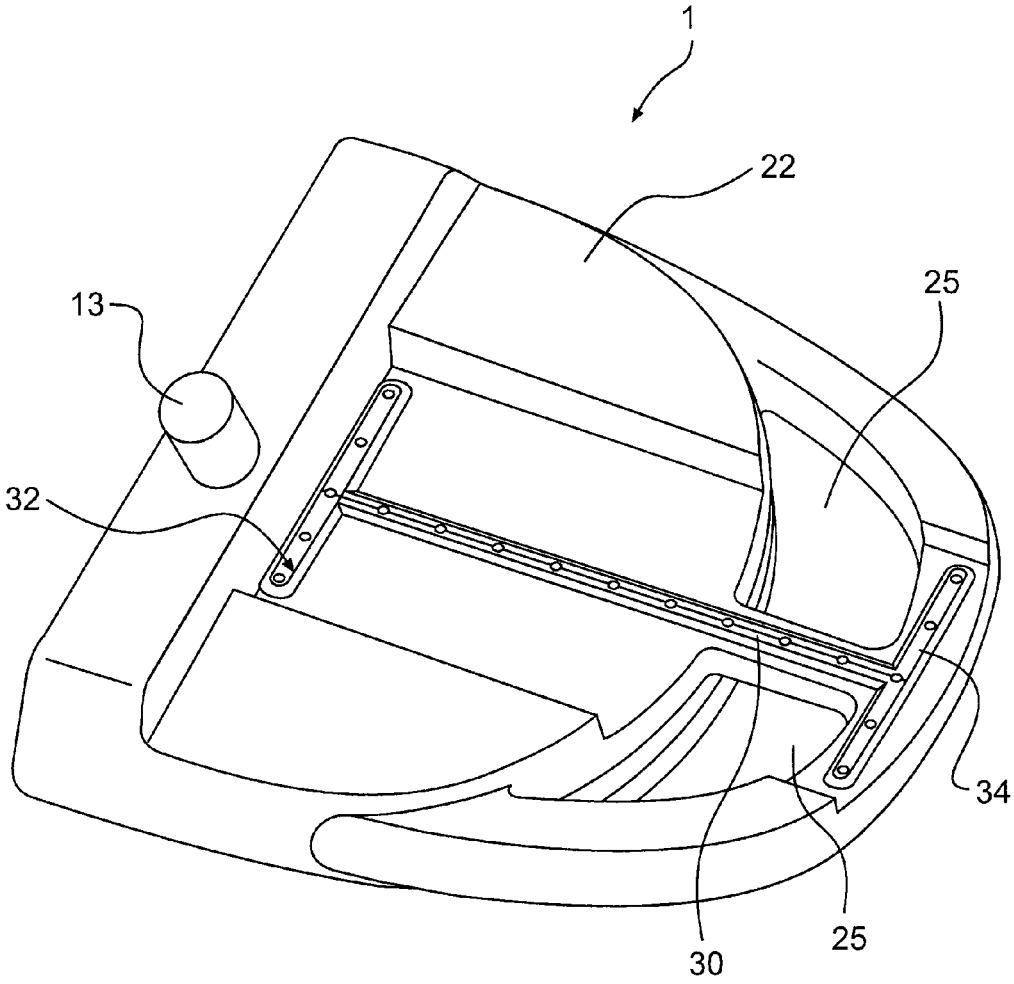
FIG. 6 shows a top view of a golf club head of the present invention.

In all of these enumerated exemplary embodiments, the sight lines are readily distinguished from the remainder of the club head 1. To further enhance this effect, the top surface of the entire club head may be darkened. This may be accomplished by providing a cover member 22 that covers the body 10 and weight member 18. This embodiment is illustrated in FIG. 6, which shows a club head 1 with a sight line 30. The sight line 30 is located on a top portion of the club head 1 and is preferably substantially aligned with the intended direction of the putt. Thus, the sight line 30 is substantially perpendicular to the strike face 11, which as used herein means substantially perpendicular to a strike face having a 0° loft angle. Providing perpendicular sight lines enhances the golfer's ability to properly align the club head. A second sight line 32 may be provided. This sight line 32 is preferably substantially perpendicular to the sight line 30 and is substantially parallel to the strike face 11. A third sight line 34 may also be provided. This sight line 34 preferably is parallel to the second sight line 32. It should be noted that the sight lines 30, 32, 34 are designated first, second, and third only for purposes of differentiation; each sight line can be used independently or in combination with any other sight line. When sight lines 32, 34 are used in conjunction, they are preferably separated by a significant distance. One sight line 32 may be positioned near the front of the club head 1, and the other sight line 34 may be positioned near the rear of the club head 1. Providing widely spaced, parallel lines makes it easier for the golfer to determine whether the club head 1 is properly aligned. These sight lines 32, 34 preferably are separated by a minimum distance of two inches or more, and the forward-most sight line 32 is preferably a maximum of 0.75 inch from the front edge of the top portion of the club head 1, adjacent the strike face 11. More preferably, the sight lines 32, 34 are separated by 2.5 inches or more.

Figure 9:
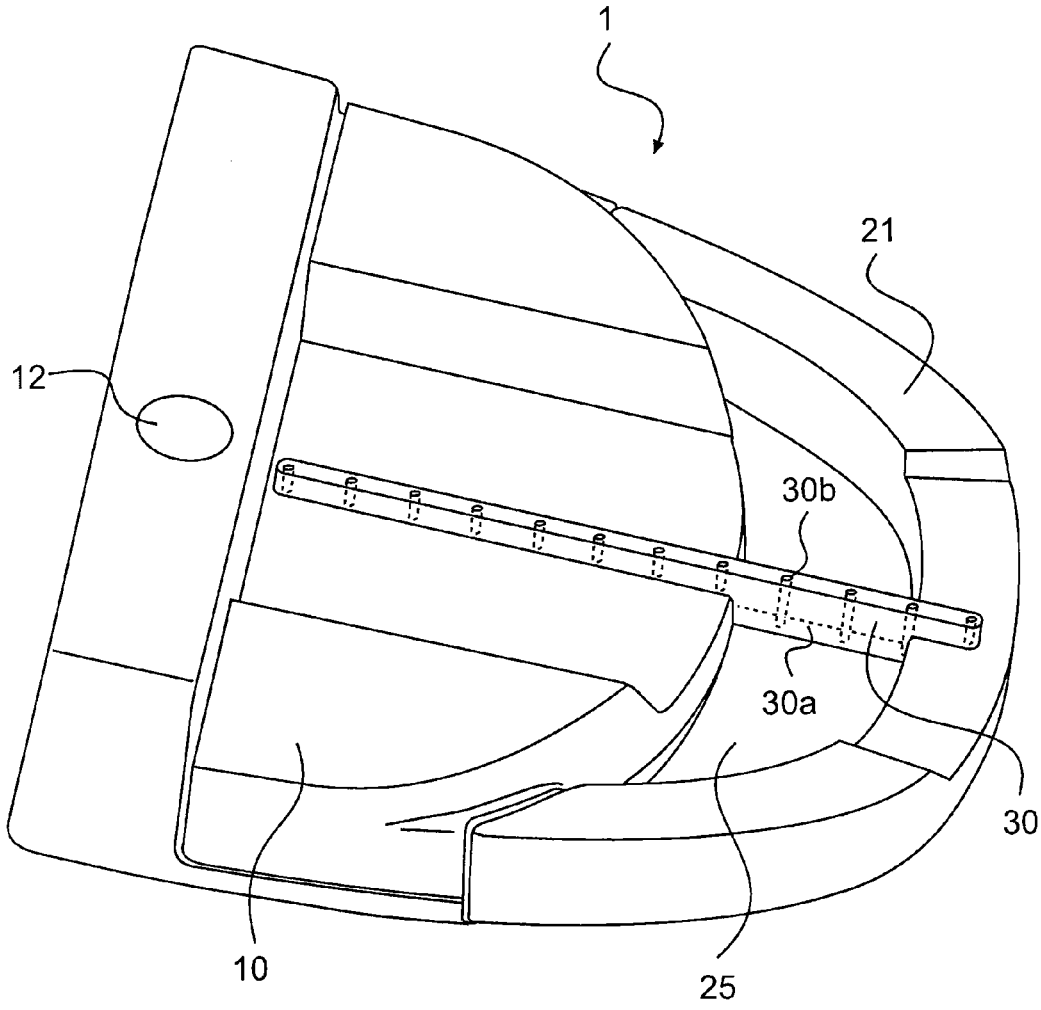
FIG. 9 shows a top view of a golf club head of the present invention.

FIG. 9 shows a preferred embodiment of the present invention. In this illustrated embodiment, the club head 1 contains a single high visibility sight line 30 that is positioned substantially perpendicularly to the strike face 11. A slot is provided in the first body member 10, into which the sight line 30 is positioned and retained in known manner. The sight line 30 extends from the first body member 10 adjacent the top line to the weight bar 21, which in the illustrated embodiment is also provided with a slot into which the sight line 30 is positioned and retained. A void 25 is provided, and the sight line 30 extends across the void 25 and into the weight bar 21. The sight line 30 includes a body 30*a* formed of a material impregnated with a luminescent pigment such as a fluorescent pigment. Secondary bodies 30*b* in the form of fiber optics and/or natural light emitting substances are placed at regular intervals along the length of the body 30*a*. To enhance the visibility of the sight line 30 even more, the top surface of the club head 1 of the illustrated embodiment has been darkened. At least the top portion of the first body member 10 has been darkened such that it is darker than the top line, making it less noticeable than the top line. At least the top portion of the weight bar 21 has been darkened such that it is darker than the first body member 10, making it less noticeable than the first body member 10. Alternatively, the first body member 10 and the weight bar 21 could be provided with the same level of darkness.

Figure 10:
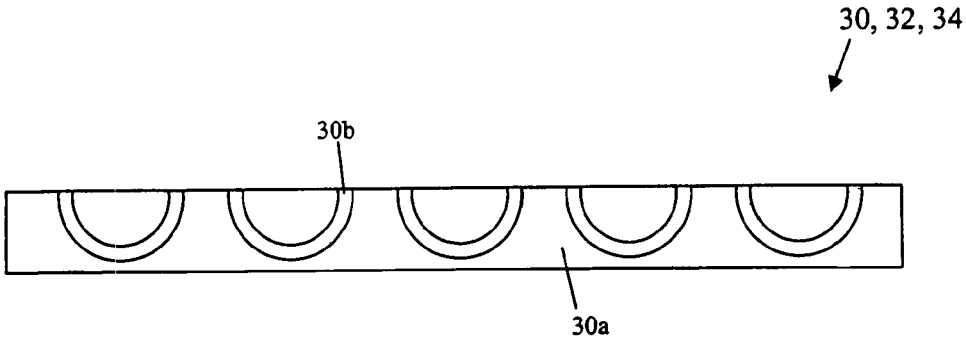
FIG. 10 shows a cross-sectional view through a preferred sight line of the present invention.

FIG. 10 shows a cross-sectional view through a preferred sight line 30, 32, 34 of the present invention. This embodiment of sight line may be used in any of the aforementioned locations, exclusively or in conjunction with other embodiments of sight line. Similar to the previously discussed sight lines, the sight line of FIG. 10 includes a body 30*a* formed of a material impregnated with a luminescent pigment such as a fluorescent pigment and secondary bodies 30*b* in the form of fiber optics and/or natural light emitting substances placed at regular intervals along the length of the body 30*a*. In this embodiment, the secondary bodies 30*b* are provided in the form of loops or u-bends with both ends of the secondary bodies 30*b* being at or near the top surface of the body 30*a*. Thus, both ends of the secondary bodies 30*b* are visible in the aiming line. This design also maximizes the brightness of the sight lines 30, 32, 34, as light is emitted through both ends of the secondary bodies 30*b*. The body 30*a* may include a dark top surface, further enhancing the contrast of the secondary bodies 30*b*. Preferably, the body 30*a* are translucent, allowing ambient light to pass therethrough and into the secondary bodies 30*b*, where it is channeled and propagated through the secondary bodies 30*b* and emitted via the secondary body ends. The body 30*a* may be provided in the form of a smoked urethane, making it relatively darker and the secondary bodies 30*a* relatively brighter. Ambient light may still propagate through the body 30*a*, though probably to a lesser extent than if the body 30*a* were completely transparent. As an alternate to having both ends of the secondary bodies 30*b* be at or near the top surface of the club head 1, one of the ends of the secondary bodies may be positioned at other beneficial locations of the club head 1. For example, one of the ends of one or more of the secondary bodies 30*b* may be positioned at or near the strike face 11, providing additional alignment assistance to the golfer. This may include one or more of these secondary bodies 30*b* being positioned within the top line 13. Additional secondary bodies 30*b* may be placed at other areas of the club head 1, such as on the weight member 18 including the bar 21.

Figure 11:
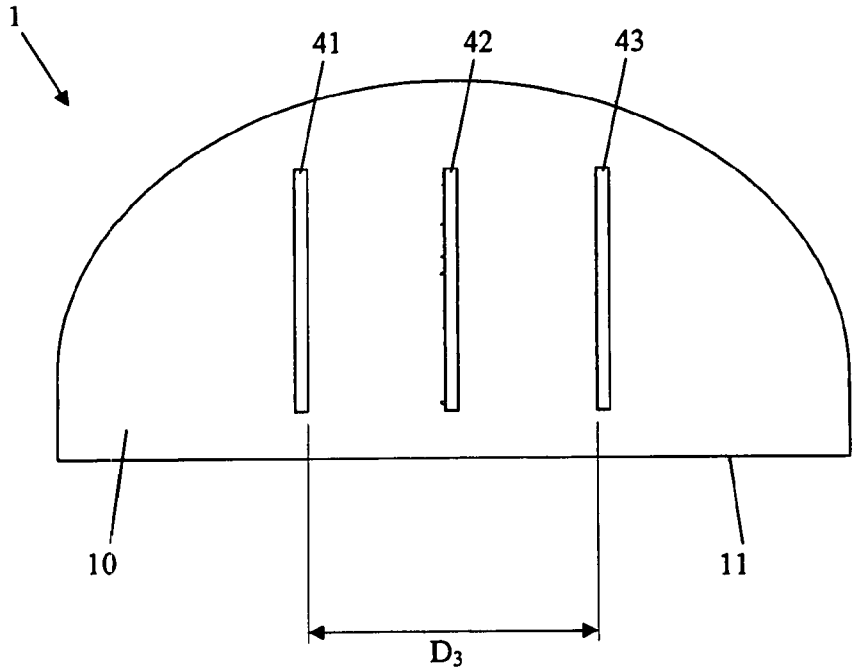
FIG. 11 shows a top view of a golf club head of the present invention.

FIG. 11 shows a top view of a golf club head of the present invention. In this embodiment, three substantially parallel sight lines 41, 42, 43 are provided. The sight lines can be provided in any of the forms discussed herein. These sight lines 41, 42, 43 are aligned with the intended direction of the putt. The outer sight lines 41, 43 preferably are spaced such that they are aligned with the outer edges of a golf ball to be struck. That is, the distance D3 preferably is equivalent to the diameter of a golf ball. For most golf balls, this distance D3 is 1.68 inches. A preferred range of lengths for distance D3 includes from 1.5 inches to 2 inches. The middle sight line 42 is optional, and may not be present. If present, the middle sight line 42 could be provided in a different color than the outer sight lines 41, 43. As one example, the outer sight lines 41, 43 could be provided in a green color and the middle sight line 42 could be provided in a red color.

Figure 12:
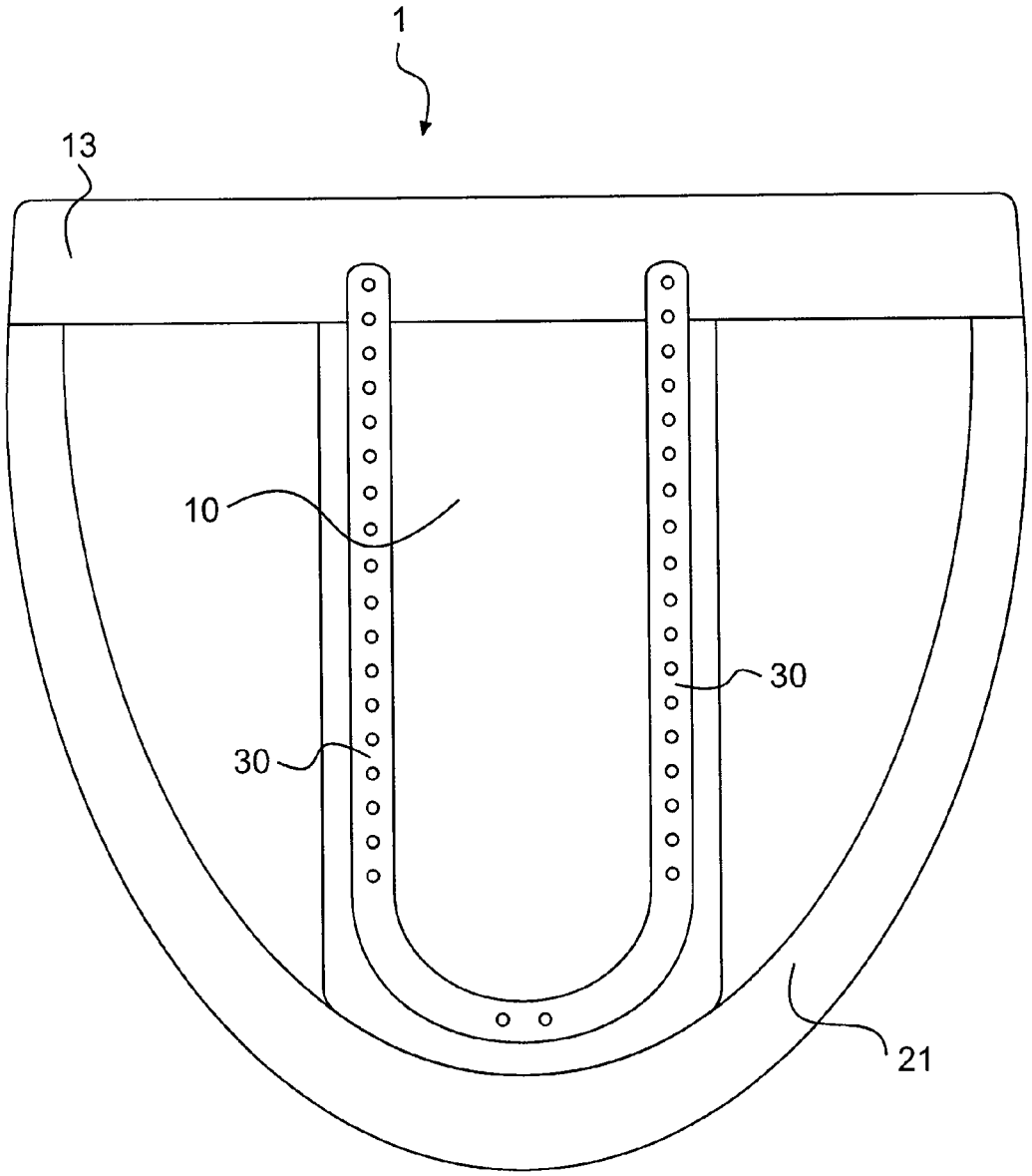
FIG. 12 shows a top view of a golf club head of the present invention.

FIG. 12 shows a top view of a golf club head 1 of the present invention. In this illustrated embodiment, two substantially parallel sight lines 30 are provided on toe and heel sides of the body member 10. These sight lines 30 may be joined together, such as looping around the rear portion of the body member 10 as shown, or they may be separate. Other sight line connection locations may be used, such as linking along the front of the club head 1, either at or adjacent the top line 13. As mentioned above, these sight lines may extend into the top line 13. In one version of the club head 1, the sight lines 30 are spaced apart at a distance that is approximately the same as a golf ball diameter, which is typically 1.68 inches. The distance between the sight lines may be the same as discussed above with respect to distance $D_3$.

The body member 10 may extend rearward to the weight bar 21, and may flare outward at the junction with the rear portion of the face member. At least the top surface of the body member 10 may be provided in a relatively dark color for the beneficial reasons discussed above. The weight bar 21 may take a horseshoe-like form, connecting directly to the face member at heel and toe portions thereof and arching around the rear portion of the body member 10, to which it may be connected.

Figure 13:
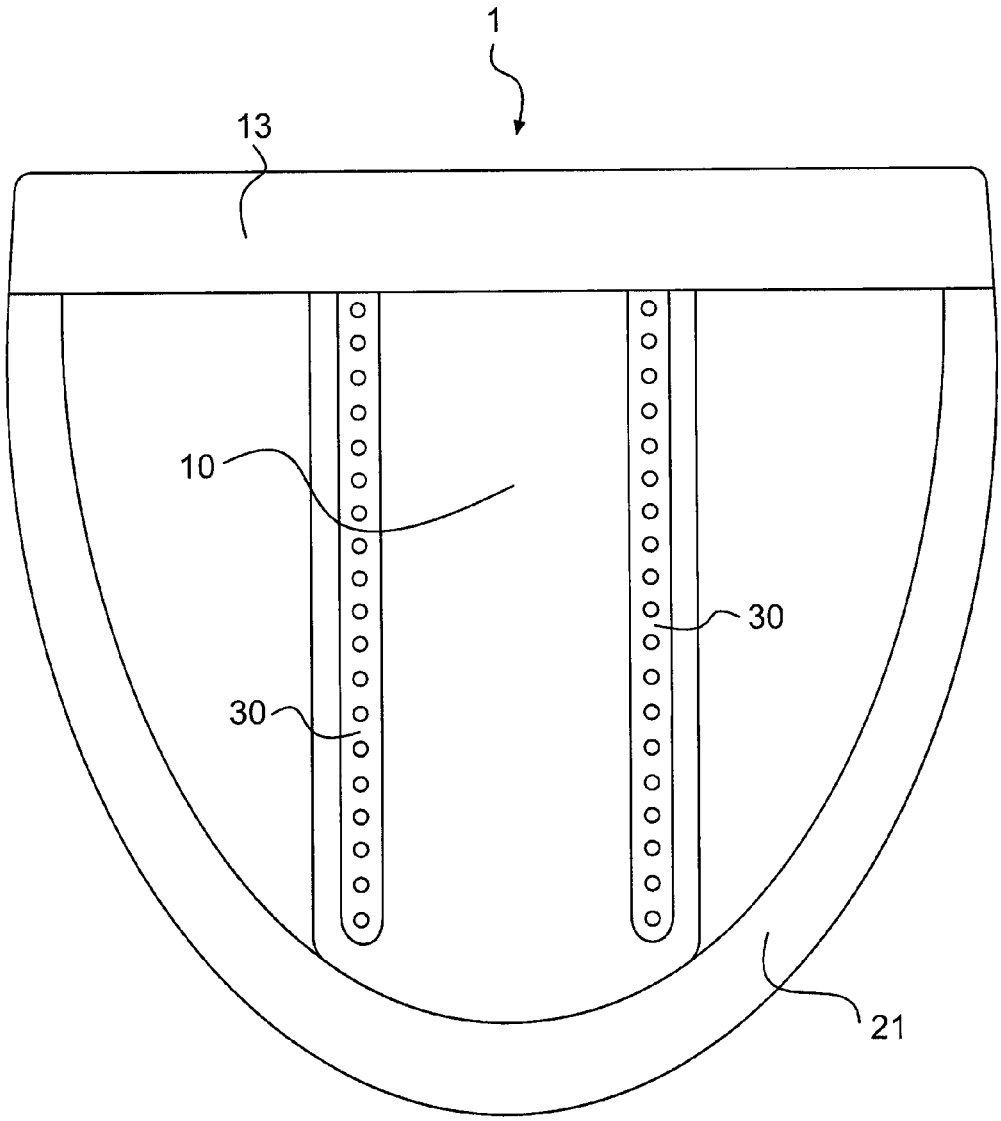
FIG. 13 shows a top view of a golf club head of the present invention.
Figure 14:
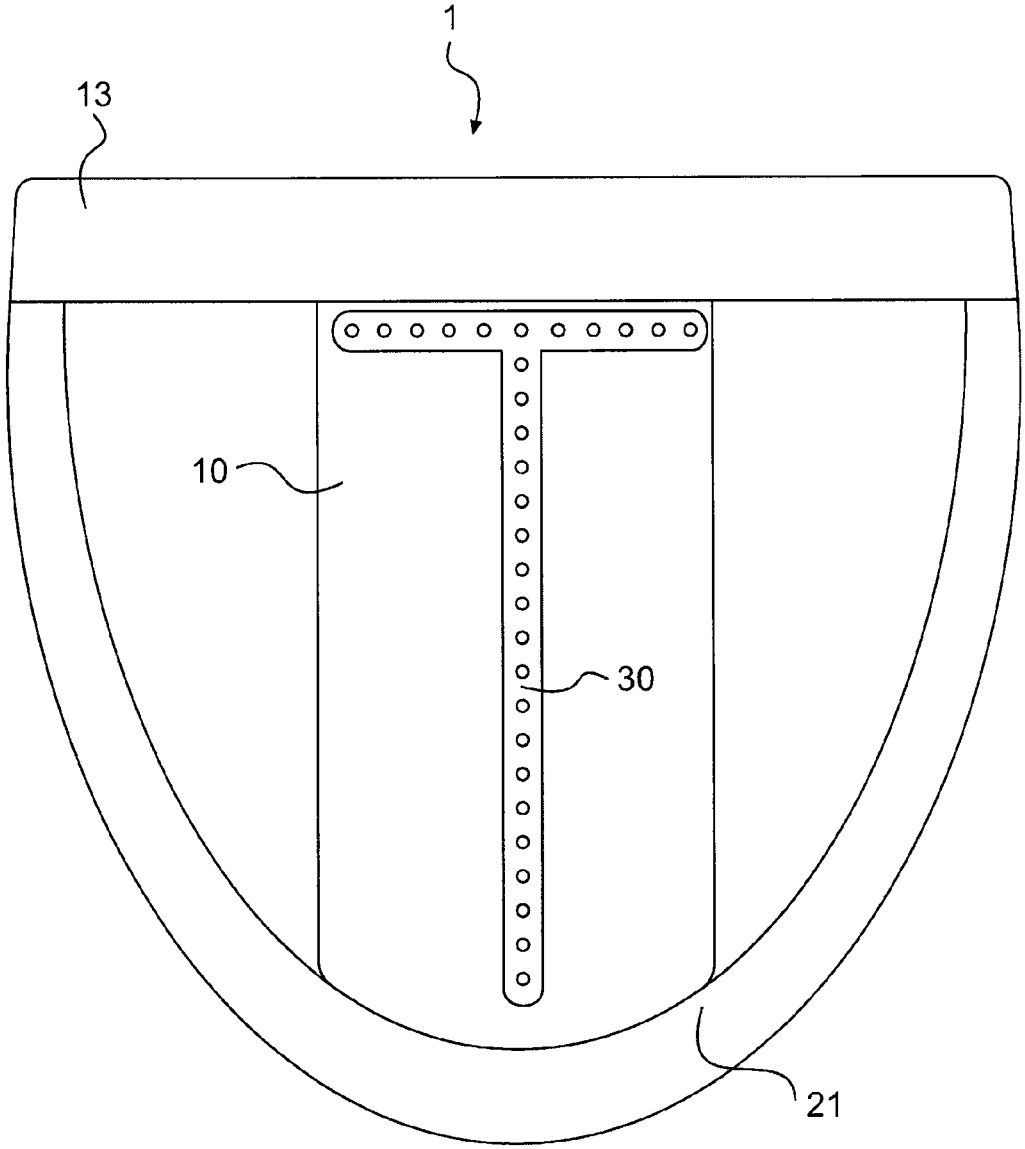
FIG. 14 shows a top view of a golf club head of the present invention.

FIGS. 13 and 14 each show top views of a golf club head of the present invention. The layout of these club heads is similar to that of the club head 1 of FIG. 12, but with different sight line configurations. In FIG. 13, two substantially parallel sight lines are provided. These sight lines are similar to those of FIG. 12, but they are not connected. In FIG. 14, a single sight line substantially perpendicular to the striking face is provided. In one embodiment, this sight line is positioned along a centerline of the body member. Additionally, a second sight line that is substantially perpendicular to the first sight line is provided. While it is shown as being positioned within or atop the body member in the illustrated embodiment, this sight line may also be provided within or atop the face member. For the sake of clarity, no shaft bores are shown on these illustrated embodiments. The shafts may be included and attached as known, with heel and center attachment locations being preferred.

The club head 1 of the present invention, including those embodiments specifically addressed above, may be manufactured in any appropriate manner as will be discernible by those of skill in the relevant art. One such manufacturing method includes forming the body 10 from a metallic material, aluminum being a preferred material. Forging is a preferred manufacturing method for forming the body 10, but other methods, such as die-casting and machining, may also be used. Secondary features, if desired, can be formed by stamping or machining. Exemplary secondary features could include grooves or holes for attaching other of the club head components. The body 10 may include the face 11, or the face 11 may alternatively be provided separately (for example, as an insert) and coupled to the body 10. A bore 12 may be created, such as via boring or drilling, so a shaft (not shown) can be attached to the club head. Alternatively, the shaft can be coupled to the club head 1 via an extension 15 that may be provided on the body 10. The shaft may be attached to the body 10 in any desired location, preferred locations including a heel side of the top line 13 near the strike face $\mathbf{1}_F$ and/or in the center of the top line 13 near the strike face $\mathbf{1}_F$. It is preferred that the face 11, sole, and shaft attachment are all included in the body 10. Keeping these elements of the club head 1 together in one component allows an effective means of keeping the club "sitting" properly, which helps ensure beneficial results in use. The shaft is coupled to the club head 1 in known fashion, and may be constrained against rotation relative the club head 1. If the shaft is positioned such that it blocks or obscures all or a portion of one or more of the sight lines 30, 32, 24 from the golfer's view, the lower portion of the shaft near its attachment to the club head 1 may be clear such that the golfer can view the sight lines 30, 32, 34 through the shaft.

The core 28 preferably is formed of a polymer, co-polymer, silicon, butite, thermoset, thermoplastic, urethane, rubber, or rubber-like material, such as elastomers, nylons, and the like. It is preferably light weight, having a density of 2 g/cm$^3$ or less. The light weight nature of the core 28 allows the club designer to use the displaced mass and weight in more useful locations. A transparent or translucent material may be used so that ambient light may propagate therethrough. Injection molding is a preferred manufacturing technique for forming the core 28. In addition to being of light weight, the material (such as the specified exemplary materials listed above) of the core 28 can also be chosen and engineered to provide vibration damping to the club head 1, beneficially enhancing the feel and playability of the club. The core 28 preferably is configured to matingly engage a corresponding cavity within the body member 10. The face insert (discussed above) may be included as part of the core 28, either as one unitary part or as a separate component coupled thereto.

The weight member/bar 21 preferably is formed of a dense metallic material and has a density of 6 g/cm$^3$ or more. Loaded plastics or urethanes or the like may be used instead of a metallic material. Forging, casting, and machining are include among preferred manufacturing methods for forming the weight member 21. The weight member 21 is configured to matingly engage the body member 10, preferably along the periphery thereof. Ends of the weight member 21 may be positioned within corresponding cavities configured to matingly receive the weight member ends, the cavities being positioned along the periphery of the body member 10.

Preferred materials for forming the cover member 22 include light weight plastics, polymers, metals, and composites. The cover member 22 preferably has a density of 3 g/cm$^3$ or less. The cover member 22 is configured to attach to the weight member 21, the body member 10, the core 28, or a combination of these elements. Decorative markings may be provided on the cover member 22. Grooves configured to matingly engage the sight lines 30, 32, 34 may be included in the cover member 22. If separate sight line components are not used, sight lines may be provided on the cover member 22.

Optionally, one or more sight lines 30, 32, 34 may be provided as separate elements. The sight lines 30, 32, 34 preferably are formed of highly fluorescent plastics, fiber optic materials, tritium materials, and the like. A preferred manufacturing method is injection molding.

The components of the club head 1 can be assembled in various manners, a preferred manner including coupling the weight member 18 (or weight bar 21) to the body member 10 through the use of mechanical fasteners. The core 28 preferably is bonded to the body 10 through the use of an adhesive, glue, epoxy, or the like. The body 10 may include a cavity contoured to matingly receive the core 28. Other means of attachment, such as co-molding or mechanical fasteners, may be used. The sight lines 30, 32, 34 may be press-fit into an underside of the cover member 22 such that the extend therethrough. Alternatively, the sight lines 30, 32, 34 are press-fit into grooves provided on the surface of the cover member 22. The cover is secured to one or more of the other components, preferably-by bonding.

Figure 15:
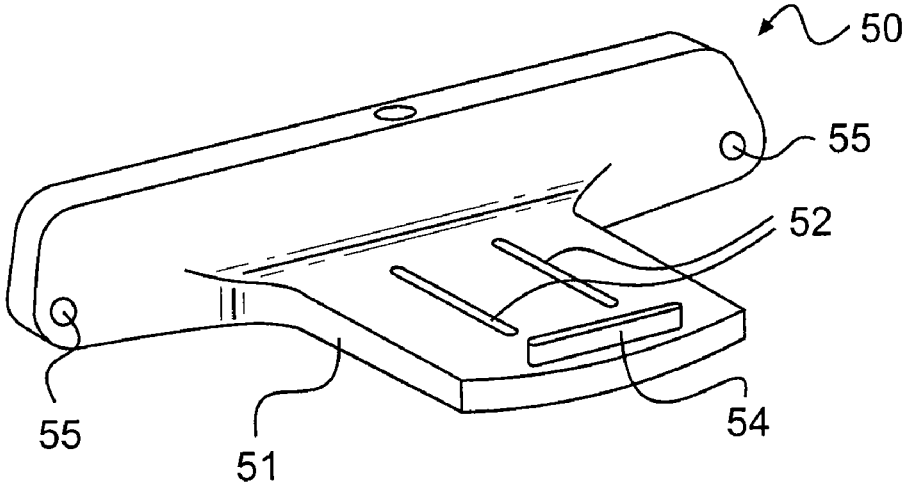
FIG. 15 shows a top perspective view of a face member for use with one embodiment of the golf club head of the present invention.

FIG. 15 shows a top perspective view of a face member 50 for use with one embodiment of the golf club head of the present invention. The face member 50 is preferably formed of a relatively light metallic material. Aluminum is one preferred material. The face member 50 includes a portion 51 extending rearward from the striking face. In this embodiment, this extension portion 51 forms at least a portion of the club head sole. The face member 50 preferably includes grooves 52, a boss 54, and holes 55 for purposes discussed below. The face member 50 may be formed in any convenient manner, with casting being a preferred manner. Various features of the face member 50, such grooves 52, boss 54, and holes 55, may be formed as part of the casting or by an additional manufacturing step, such as machining.

Figure 16:
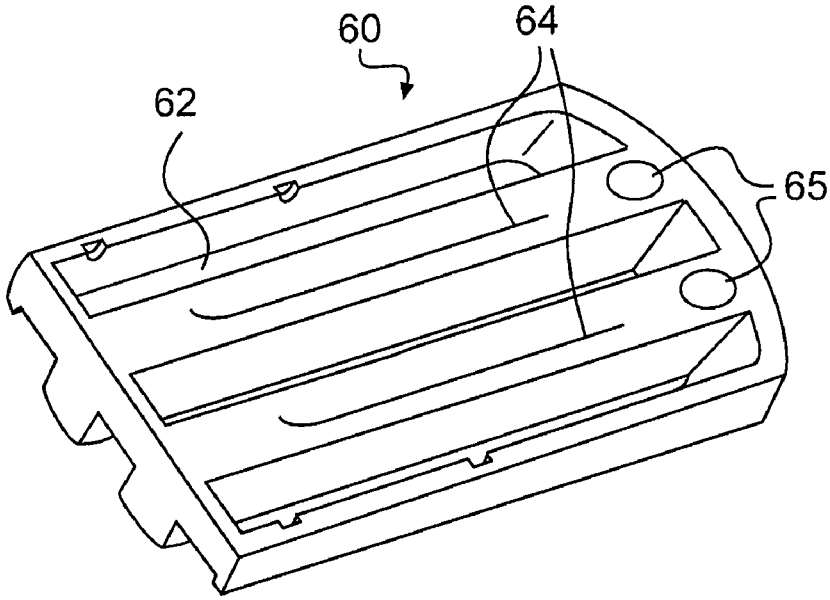
FIG. 16 shows a bottom perspective view of a second body member or core member for use with the face member of FIG. 15.

FIG. 16 shows a bottom perspective view of a second body member or core member 60 for use with the face member 50 of FIG. 15. The core member 60 forms at least a portion of the top portion of the club head when assembled. Thus, preferably it is of a relatively dark color. The core member 60 defines one or more slots 62 therein for receiving the sight line assemblies 30. As illustrated, these slots 62 may contain notches extending outward in lower portions of the core member 60. The sight lines 30 may be provided with corresponding extensions such that when the sight lines 30 are inserted through the lower surface of the core member 60, the extensions match up with the notches and the sight lines 30 are captured within the core member 60, restrained from passing completely through the core member 60. By inserting the sight lines 30 into the core member 60 in this manner prior to attaching the core member 60 to the face member 50, the sight lines 30 are locked in place in the assembled club head. The core member 60 preferably also defines bosses 64 extending outward from the lower surface thereof. These bosses match up with the face member grooves to seat and retain the core member 60 in the desired position. The core member 60 may further define holes 65, which may be used to retain weight members for adjustment of the club head swing weight. The core member 60 preferably may be formed of a light, low density material such as polyurethane, and may be formed by injection molding or otherwise.

Figure 17:
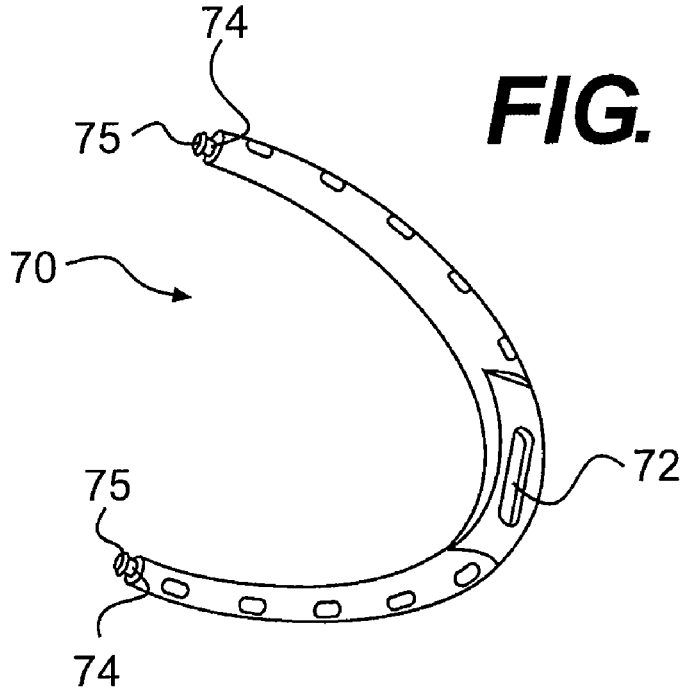
FIG. 17 shows a bottom perspective view of a weight bar for use with the face member of FIG. 15 and the core member of FIG. 16.

FIG. 17 shows a bottom perspective view of a weight bar 70 for use with the face member 50 of FIG. 15 and the core member 60 of FIG. 16. The weight bar 70 is similar to that of FIGS. 12-14, and through the material selection, size (note that the cross-section size may vary along the length of the weight bar 70), position, etc. imparts the desired center of gravity and MOI attributes to the club head. (If weights are included, such as within the holes 65, they would also contribute to the club head center of gravity and MOI attributes.) The weight bar 70 preferably defines a groove 72, which corresponds to the face member boss 54. The weight bar 70 further preferably includes extensions 74 from its ends, the extensions 74 corresponding to the face member holes 55. Thus, the extensions 74 are configured to matingly fit (and be retained) within the face member holes 55, and the weight member groove 72 is configured to matingly receive (and retain therein) the face member boss 54. An O-ring 75 may be included with each extension 74 to ensure a tight fit between the extensions 74 and the holes 55 and therefore a solid feel to the resulting golf club. A groove may be provided around each extension 74 to seat the O-ring. The weight bar 70-may be formed of a variety of materials, relatively dense materials such as steel being preferred, and may be manufactured by casting, forging, or otherwise.

Figure 18:
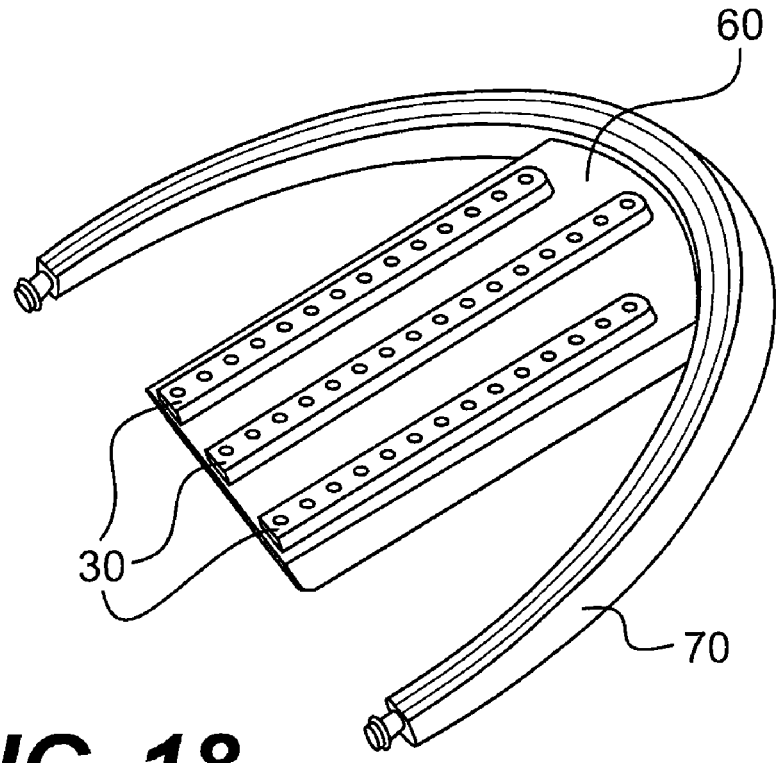
FIG. 18 shows a partially assembled club head of the present invention.

To assemble this club head, the sight lines 30 are first inserted into the core member slots 62 as previously described. The core member 60—sight line 30 subassembly may then be positioned on the face member 50 with the bosses 64 and grooves 52 ensuring the proper spatial relationship is achieved and maintained. An adhesive or epoxy may be used to affix these club head elements together. Next, the weight bar extensions 74 (and, optionally, the 0-rings 75) are positioned within the face member holes 55, and the rear portion of the weight bar 70 then lowered onto the face member boss 54. An adhesive or epoxy may be used to affix the face member 50 and weight bar 70. It should be noted that due to the placement of the extensions 74 within the holes 55, the adhesive/epoxy is only necessary at the rear portions of the face member 50 and weight bar 60. The rear portion of the core member 60 preferably is curved and configured to fit adjacent an inner portion of the weight bar 70. A step extending rearward from the curved portion of the core member 60 and extending under the weight bar 70 or within a cavity defined within the weight bar 70 may help retain the club head elements together. FIG. 18 shows a partially assembled club head, including the core member 60, sight line assemblies 30, and weight bar 70.

As used herein, directional references such as rear, front, lower, upper, etc. are made with respect to the club head when grounded at the address position. The direction references are included to facilitate comprehension of the inventive concepts disclosed herein, and should not be read or interpreted as limiting.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. For example, while the present invention has been described above with respect to a putter, the present invention may also be employed with other golf clubs, such as irons, hybrids or utility clubs, woods, and metal woods. Thus the present invention should not be limited by the above-described exemplary embodiments, but should be defined only in accordance with the following claims and their equivalents.

What is claimed is:

1. A golf club head, comprising:

a face portion including a strike face;

an extension portion extending rearward of the face portion and comprising a weight mounting slot;

a weight mounted in the weight mounting slot, wherein the weight can be slid within the slot to adjust a center of gravity of the club head in at least a front to back direction relative to the face portion; and a sight comprising a boss portion extending upward from the extension portion defining a sight line that extends perpendicular to the strike face.

2. The golf club head of claim 1, wherein a cross section of the slot has a T shape.

3. The golf club head of claim 2, further wherein the weight has a T shaped portion corresponding to the cross section shape of the slot.

4. The golf club head of claim 1, wherein the weight is adjustable relative the face portion in a heel to toe direction.

5. The golf club head of claim 1, wherein the weight mounting slot is arc shaped.

6. The golf club head of claim 1, further comprising two slots.

7. The golf club of claim 1, further wherein the weight comprises a set screw that comprises a tool engagement surface.

8. A golf club head, comprising:

a face portion including a strike face;

an extension portion extending rearward of the face portion and comprising an arc-shaped weight mounting slot, wherein a cross section of the slot has a T shape; and a weight mounted in the weight mounting slot, wherein the weight can be slid within the slot to adjust a center of gravity of the club head in at least a front to back direction relative to the face portion, and further wherein the weight is sized such that it is able to be slid into the slot and then rotated within the slot such that it is retained therein.

9. The golf club head of claim 8, further wherein the weight has a T shaped portion corresponding to the cross section shape of the slot.

10. The golf club head of claim 8, wherein the weight is adjustable relative to the face portion in a heel to toe direction.

11. The golf club head of claim 8, further comprising two slots.

12. The golf club of claim 8, further wherein the weight comprises a set screw.

13. The golf club of claim 12, further wherein the set screw comprises a tool engagement surface.

* * * * *